US006196875B1

(12) United States Patent
Harting et al.

(10) Patent No.: US 6,196,875 B1
(45) Date of Patent: Mar. 6, 2001

(54) SCREENED ELECTRICAL PLUG CONNECTION

(75) Inventors: Dietmar Harting, Espelkamp; Günter Pape, Enger; Dieter Lüttermann, Lübbecke, all of (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/493,972

(22) Filed: Jan. 28, 2000

(30) Foreign Application Priority Data

Feb. 23, 1999 (DE) ..... 199 07 635

(51) Int. Cl.[7] ..... H01R 13/648
(52) U.S. Cl. ..... 439/607
(58) Field of Search ..... 439/101, 108, 439/607–610, 677

(56) References Cited

U.S. PATENT DOCUMENTS

| | | | |
|---|---|---|---|
| 5,500,788 | | 3/1996 | Longueville et al. . |
| 5,611,700 | | 3/1997 | Mitra . |
| 5,685,738 | | 11/1997 | Harting et al. . |
| 5,934,939 | | 8/1999 | Thenaisie et al. . |
| 6,042,398 | * | 3/2000 | Wu et al. . |

FOREIGN PATENT DOCUMENTS

WO 98/09354 3/1998 (WO) .

* cited by examiner

*Primary Examiner*—Khiem Nguyen
(74) *Attorney, Agent, or Firm*—Cook, Alex, McFarron, Manzo, Cummings & Mehler, Ltd.

(57) ABSTRACT

For a screened electrical plug connection, it is proposed that contact-making between the screening plates of two plug connectors be carried out side by side in one plane, under which circumstances a smaller overall height is achieved.

4 Claims, 4 Drawing Sheets

SCREENED ELECTRICAL PLUG CONNECTION

The invention relates to a screened electrical plug connection for printed circuit boards, in particular surface-mounted plug connectors of shallow constructional type, consisting of a plug connector in which electrical connecting elements intended for making contact with pin contacts on a complementary plug connector are disposed in an insulated manner, at least one side of the plug connectors being masked with a screening plate which has connecting ends for connection to conductor tracks on a printed circuit board, and electrical contact between the screening plate of the plug connector and the screening plate of the complementary plug connector being made by means of contact elements.

Screening of electrical plug connectors is necessary in order to improve the transmission properties in the high frequency range and also to reduce, as far as possible, inherent and also extraneous interference signals.

It is known practice to screen plug connections against interference signals by means of screening parts which are to be provided in an all-round manner, contact-making taking place via contact elements in the front region in which the plug connectors touch. However, superposed contact-making has an adverse effect on the overall height of the plug connectors.

From the generic EP 0 637 858 A1, a screened electrical plug connection for printed circuit boards is known which consists of a plug connector in which there are disposed, in an insulating manner, electrical connecting elements which are intended for making contact with pin contacts on a complementary plug connector, at least one side of the plug connectors being masked with a screening plate which has connecting ends for connection with conductor tracks on a printed circuit board.

In addition, a screened plug connector for printed circuit boards is known from WO 98/09 354 A1, in which a shrouding plate is provided for screening purposes between the rows of contact elements in each plug connector, and the contact elements lie in the same plane as the shrouding plates.

The underlying object of the invention is to construct a screened plug connection of the initially mentioned type, to the effect that a screening system is provided which reduces the overall height to a minimum.

This object is achieved through the fact that the contact elements are disposed in the same plane as the screening plates and are designed as annular contact tongues which protrude from the front terminating edge of the screening plates, touching occurring via the lateral contact faces when the plug connection is joined together.

Advantageous refinements of the invention are indicated in claims 2 to 4.

The advantages achieved with the invention particularly consist in the fact that the overall height of the plug connection is decisively reduced. Furthermore, a constant impedance profile along the signal path is obtained because of the distance, which remains the same over the entire breadth of the plug, between the plug contacts and the screening system. The spring tongues, which are of annular construction and are closed in on themselves, also exhibit a better screening effect than conventional, narrow screening tongues.

An exemplified embodiment is represented in the drawings and will be explained in greater detail below.

Figure 1:
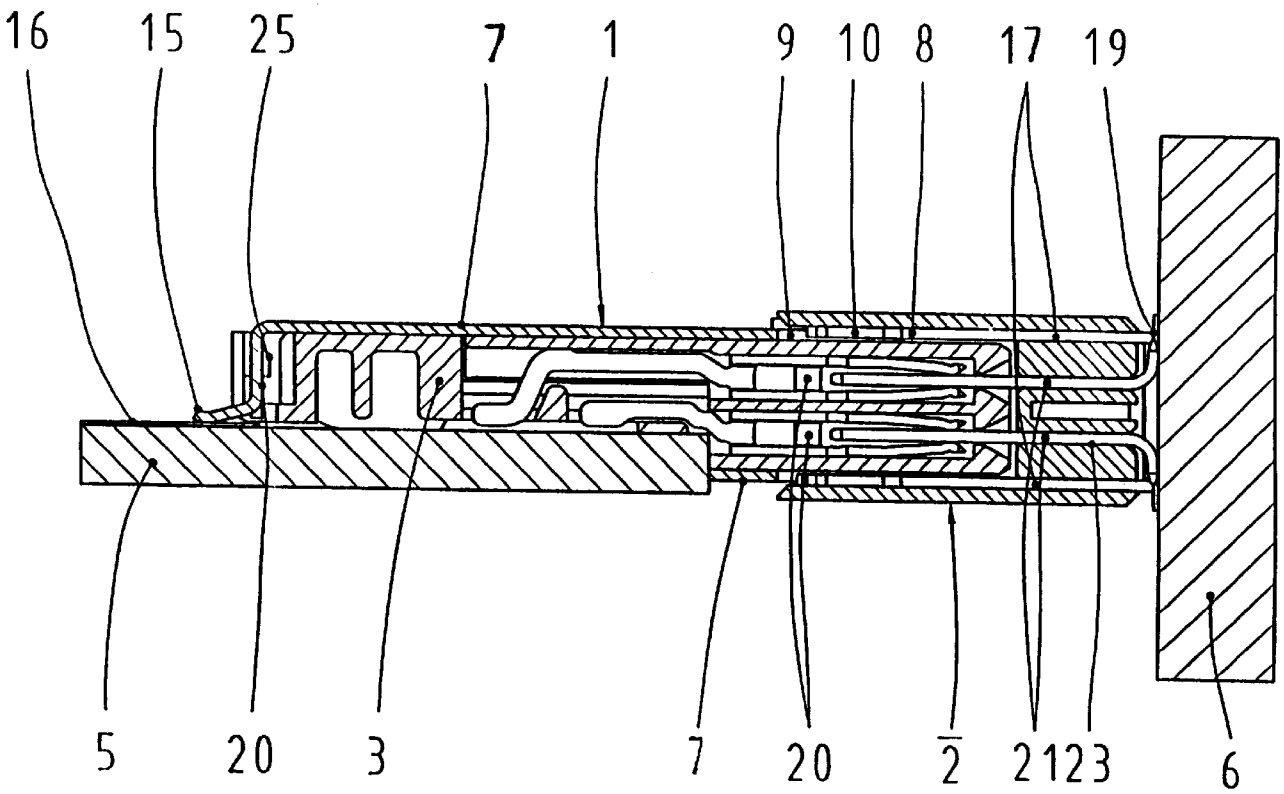
FIG. 1 shows a sectional representation of a plug connection.
Figure 2:
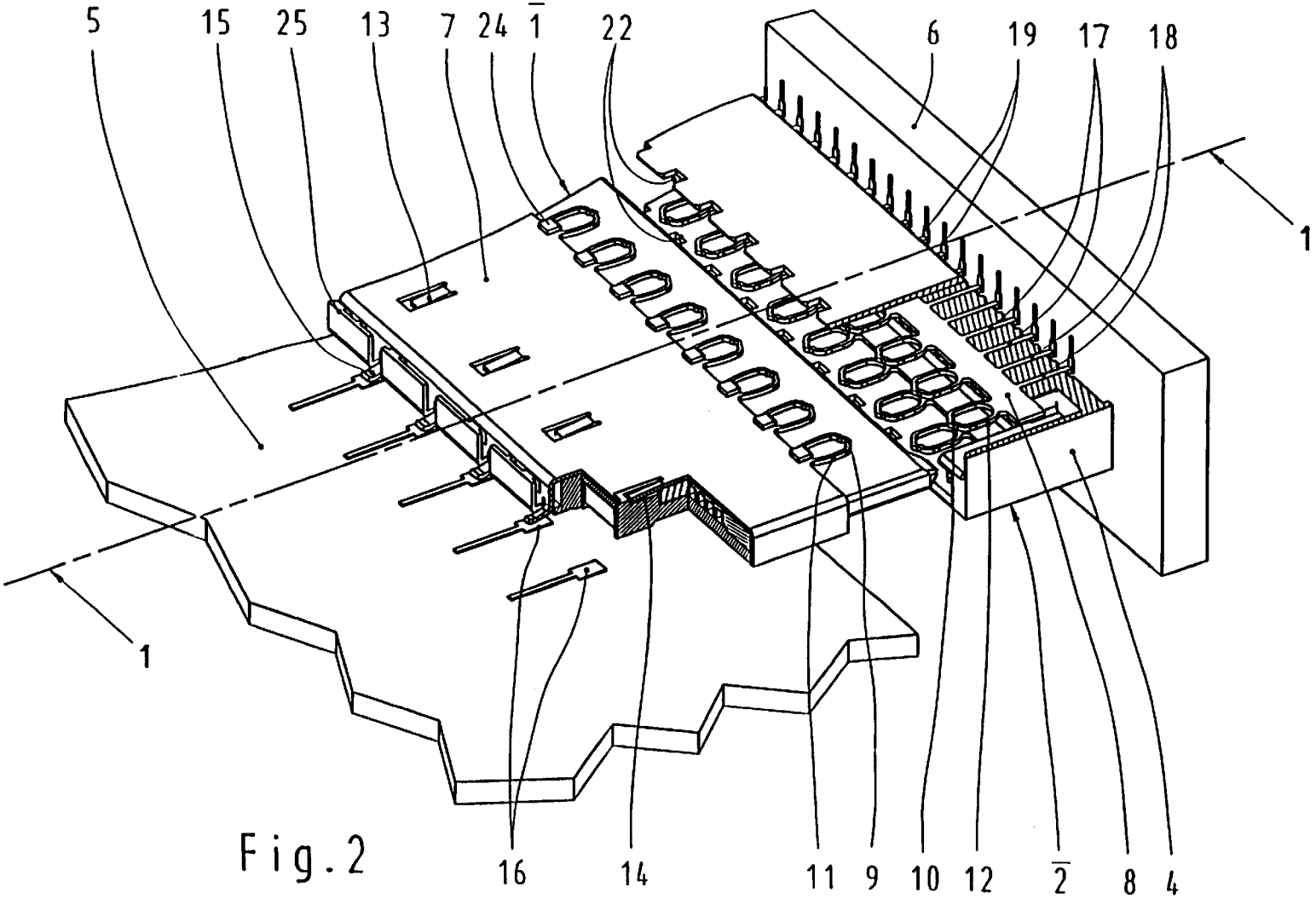
FIG. 2 shows a perspective representation of the plug connection in the non-plugged-in condition.

A plug connection consisting of a plug connector 1 and a counter-plug 2 is represented in FIGS. 1 and 2.

The sectional representation in FIG. 1 shows, mounted on a printed circuit board 5, the plug connector 1 with its forwardly protruding electrical spring contacts 20 which are disposed in rows and columns inside the insulating casing 3.

Contact with the counter-plug 2 is made via the knife contacts 21 which are guided in lead-throughs 23 inside the insulating casing 4 and permit the electrical connection of signals to a printed circuit board 6. The screening plate 7 on the upper and lower side of the plug connector 1 is connected to conductor tracks 16 on the printed circuit board 5 by means of contact tabs 15, represented in resilient form in this case, the screening plate 7 being locked with the insulating body 3 in the groove 25. The screening plates 8 of the counter-plug 2 are connected via conductor tracks 19 to the earth potential of the printed circuit board 6 by means of pin-shaped shrouding contacts 17 which are guided through openings 18 in the insulating body 4.

In FIG. 2, the two plug connectors 1 and 2 are shown, represented in perspective, in their position just prior to being plugged together. Under these circumstances, it can be seen that the screening plates 8 of the counter-plug 2 are disposed—at the top and bottom—inside the outer boundary of the insulating body 4, while the knife contacts 23 for the electrical transmission of signals are inserted, disposed in rows and columns, between the said screening plates (see also FIG. 1).

There are also provided, in the upper and lower outer boundary of the plug connector 2, rectangular clearances 22 in which the shallow fastening hooks 24 for the screening plate 7 of the plug connector 1 are inserted in such a way, when the two plug connectors are plugged together, that an uninterrupted transition between the surfaces of the two plug connectors is achieved.

Figure 3:
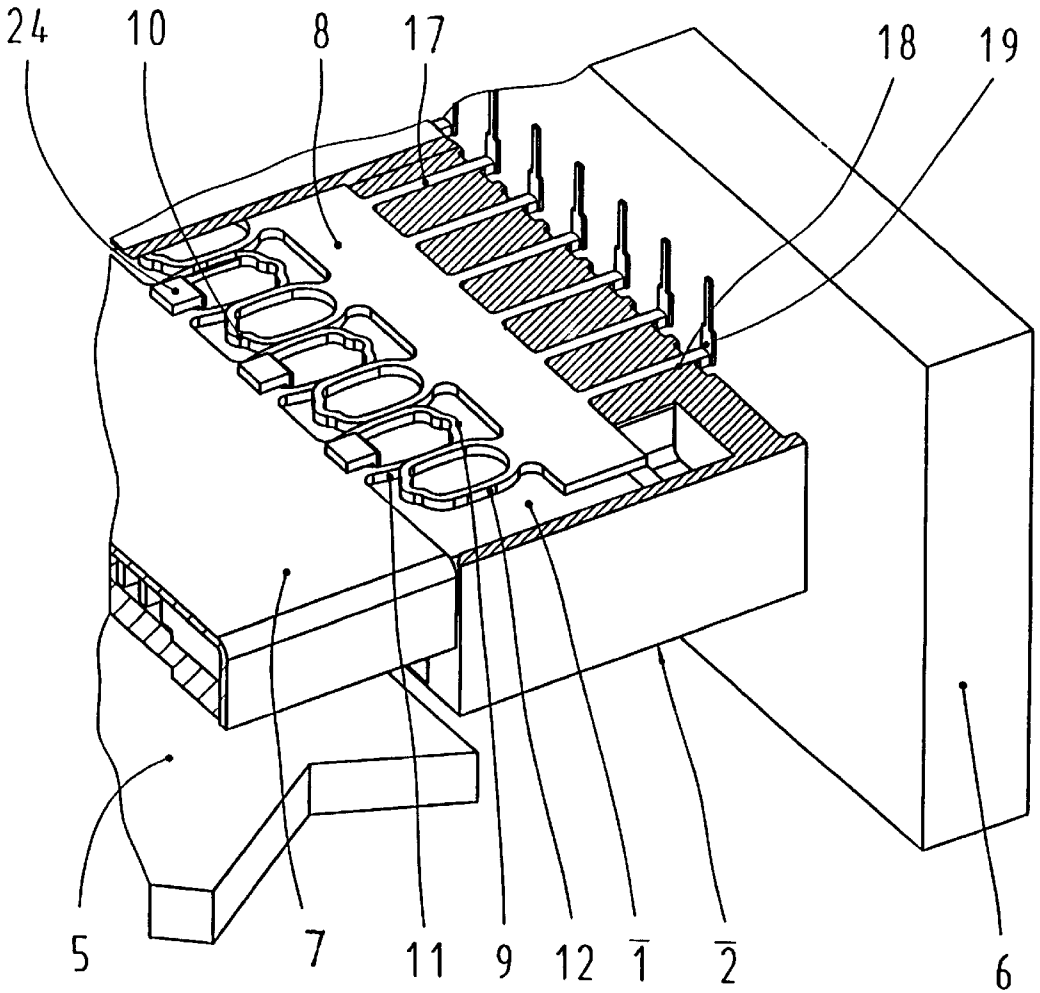
FIG. 3 shows a perspective detail drawing of a plugged-in connection.

As can also be seen from FIGS. 2 and 3, the screening plate 7, on being fitted, is first of all pushed, with its contact tongues 9, into the front, shallow fastening hooks 24 of the plug connector 1 and then locked into corresponding depressions 14 in the insulating casing 3 of the plug connector 1 with the aid of locking tabs 13. In the process, the screening plate 7 is simultaneously inserted with its rear terminating part 26, which is bent by 90°, into a correspondingly shaped groove 25 in the insulating casing 3 of the plug connector 1, where it is locked by means of locking elements, of which no further details are shown here. This ensures an electrical connection via the contact tabs 15, which are of resilient construction in this case and which press on the conductor tracks 16 of the printed circuit board 5.

If, as can be seen in FIG. 3, the two plug connectors are connected to one another, contact between the screening plates 7 and 8 of the two plug connectors 1 and 2 is made, on the particular plugging-in side, through the fact that the contact tongues 9 and 10 are pushed, side by side in one plane, into the gaps which are provided alternately in each case, so that the annularly constructed contact tongues 9 and 10 touch each other on the lateral contact faces 11 and 12. In the process, the oval rings shown in the example are compressed slightly and produce a reliable electrical contact.

Figure 4:
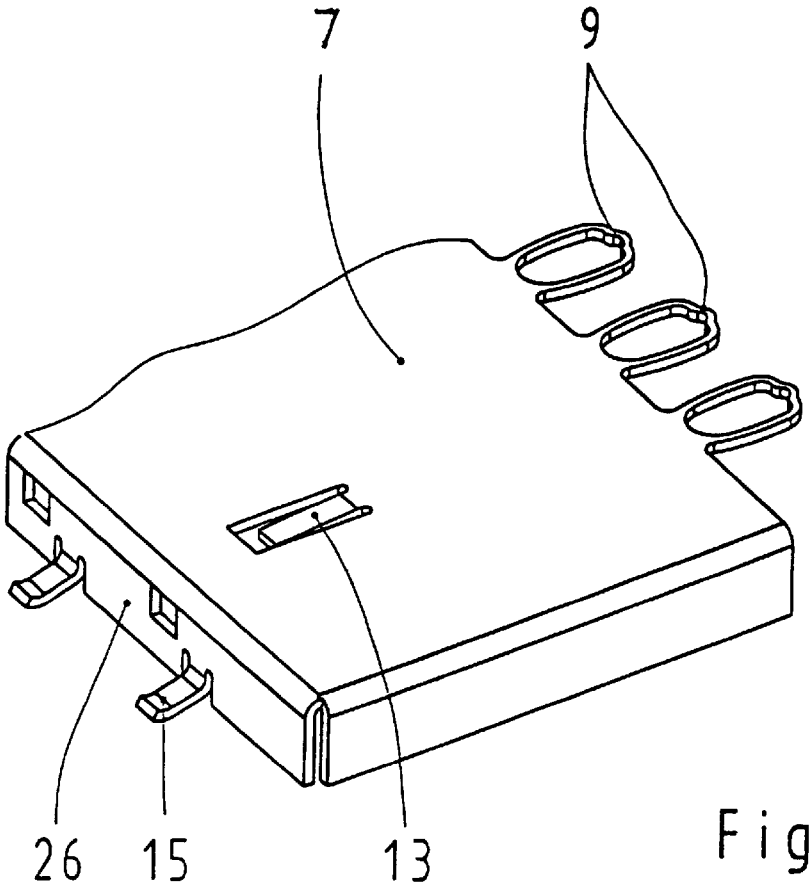
FIG. 4 shows a perspective detail drawing of a screening plate.

FIG. 4 shows, once again in a perspective partial representation, the screening plate 7 with the annular contact tongues 9 and with a locking tab 13 let into the surface, and also shows the contact tabs 15 for an earth potential connection, which contact tabs—of resilient design in this case—are added in the terminating part 26 which is bent by 90°.

Figure 5:
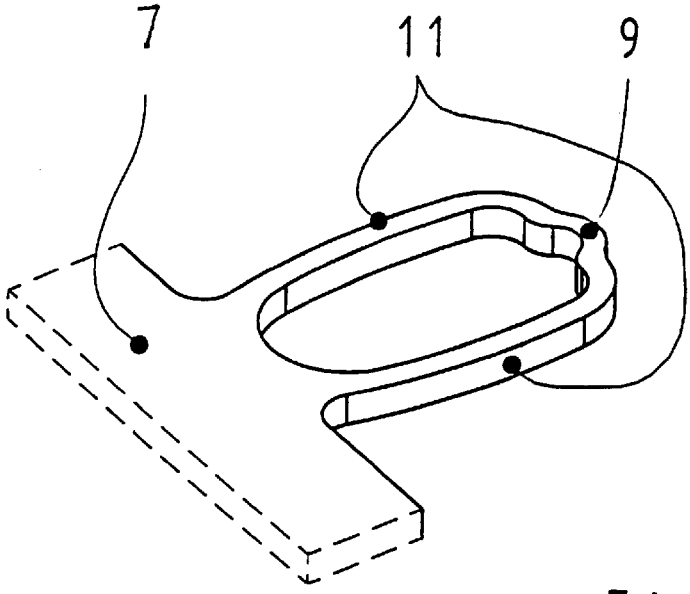
FIG. 5 shows a perspective detail drawing of a spring tongue.

A contact tongue 9, which is provided for connecting the plug connection to the earth potential, is reproduced in detail in FIG. 5. It emerges on the front side of the screening plate 7 in the form of a circular or oval ring and clearly displays the lateral contact faces 11 of the contact tongue which are necessary for making contact with the screening system.

What is claimed is:

1. Screened electrical plug connection for printed circuit boards, in particular surface-mounted plug connectors of shallow constructional type, consisting of a plug connector (1) in which electrical connecting elements intended for making contact with pin contacts on a complementary plug connector (2) are disposed in an insulated manner, at least one side of the plug connectors (1, 2) being masked with a screening plate which has connecting ends for connection to conductor tracks on a printed circuit board, and electrical contact between the screening plate (7) of the plug connector (1) and the screening plate (8) of the complementary plug connector (2) being made by means of contact elements, characterized in that the screening plates (7, 8) being in the same plane and the contact elements being disposed in the same plane as the screening plates (7, 8), the contact elements having annular contact tongues (9, 10) which protrude from the front terminating edge of the screening plates (7, 8), with contact being made between lateral contact faces (11, 12) when the plug connection is joined together.

2. Screened electrical plug connection according to claim 1, characterised in that the insulating body (3) of the plug connector (1) is provided with fastening hooks (24), under which the screening plate (7) is pushed in.

3. Screened electrical plug connection according to claim 2, characterized in that the screening plate (7) is provided with resilient locking tabs (13) which engage in depressions (14) in the plug connector (1).

4. Screened electrical plug connection according to claim 3, characterized in that the screening plate (7) has an offset terminating part (26), and that the insulating body (3) of the plug connector (1) has a groove (25), the terminating part (26) locking in the groove (25) by means of let-in locking elements, and contact tabs (15) being pressed onto conductor tracks (16) on a printed circuit board (5).

* * * * *